US006401866B1

(12) United States Patent
Roy

(10) Patent No.: US 6,401,866 B1
(45) Date of Patent: Jun. 11, 2002

(54) MACHINE FOR LEVELING A LADDER ON AN UNEVEN SURFACE

(75) Inventor: Daniel James Roy, Plainfield, IN (US)

(73) Assignee: Daniel J. Roy, Plainfield, IN (US)

( * ) Notice: Subject to any disclaimer, the term of this patent is extended or adjusted under 35 U.S.C. 154(b) by 0 days.

(21) Appl. No.: 09/751,238

(22) Filed: Dec. 29, 2000

(51) Int. Cl.[7] ..... E06C 1/00; E06C 7/00
(52) U.S. Cl. ..... 182/204; 182/205
(58) Field of Search ..... 182/200, 201, 182/202, 203, 204, 205; 248/188.2, 188.3, 188.4

(56) References Cited

U.S. PATENT DOCUMENTS

| | | | | | |
|---|---|---|---|---|---|
| 970,425 | A | * | 9/1910 | Curran | 182/205 |
| 971,997 | A | * | 10/1910 | Henning | 182/205 |
| 1,419,748 | A | * | 6/1922 | Miller | 182/205 |
| 1,887,495 | A | * | 11/1932 | Carter, Jr. | 182/205 |
| 2,152,895 | A | * | 4/1939 | Longtin | 182/205 |
| 3,016,103 | A | * | 1/1962 | Studer | 182/204 X |
| 3,406,785 | A | * | 10/1968 | Pilcher | 182/205 |
| 3,527,321 | A | * | 9/1970 | Brown | 182/205 |
| 3,882,966 | A | * | 5/1975 | Fasano | 182/205 |
| 4,802,471 | A | | 2/1989 | Cordell | |
| 5,476,153 | A | * | 12/1995 | Dickerson et al. | 182/204 |
| 5,497,850 | A | | 3/1996 | Patterson | |
| 5,542,497 | A | | 8/1996 | Macyszyn | |
| 5,551,529 | A | | 9/1996 | Molitor | |
| 5,609,222 | A | | 3/1997 | Horbacewicz | |
| 5,678,656 | A | * | 10/1997 | Lanzafame | 182/205 |
| 5,845,744 | A | | 12/1998 | Beck | |

OTHER PUBLICATIONS

Ladder Man Inc., The Ladder Book Catolog # 002B, p. 62, Part # 09015 and 07019 3025 Silver Drive, Columbus, OH 43224–3962 (www.ladder.com).
Sears Industrial Sales, Catalog. 2000–2001 year, p. 361 p/n F9–WN802 Phone 1–800–776–8666, No month available.

* cited by examiner

*Primary Examiner*—Daniel P. Stodola
*Assistant Examiner*—Hugh B. Thompson

(57) ABSTRACT

A machine for leveling a ladder on a uneven surface, with a support housing attached to one or both ladder legs, having an interior cavity for a telescoping leg, two inner drilled lugs that support a release and lock lever, two outer drilled lugs that overlap the ladder legs for more secure mounting, both support housings mount to each ladder leg in such a way that the load sits directly over the machine with out increasing the width of the ladder. A release and lock lever attached to the support housing, that automatically locks into a telescoping leg by spring action when released making it unnecessary for locking pins or bolts, a release and lock lever, rotating on a rotation shaft, with a positive gear tooth lock that engage into the telescoping leg, a telescoping leg with a large number of machined or molded gear teeth that telescopes out of the interior cavity of the support housing, a release and lock lever that rotates on a shaft and wedges into the telescoping leg according to the weight applied to the ladder, a spring fixed between release and lock lever and support housing to hold the mechanism in the lock position until actuated, a rotation shaft fix between two support housing lugs held in place by lock rings. This machine has a fine gear tooth pattern allowing for a large number of increments of adjustments.

1 Claim, 4 Drawing Sheets

A
20
22
21
23
31
25
26
41
27
33
28
38
42
36
37
29
A

A-A
22
23
25
26
41
27
28
34
36
39
37
29

B
20
21
23
49
B 25
32
26
30
27
41
33
40
28
35
34
36
37
39
21
23
49
47

31
25
26
30
27
33
41
34
28
35
28
39
36
37

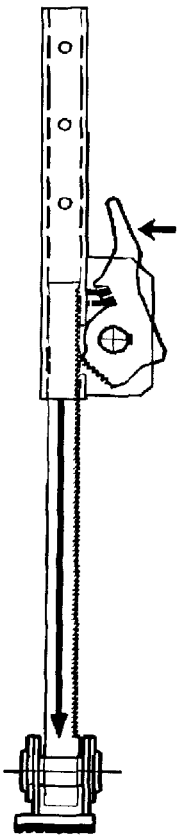
Fig. 6
Fig. 6A
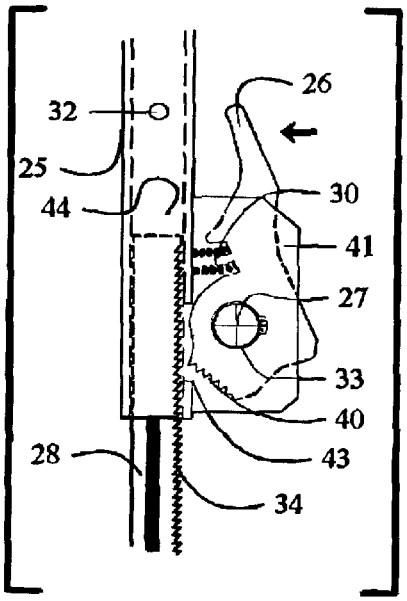
Fig.7
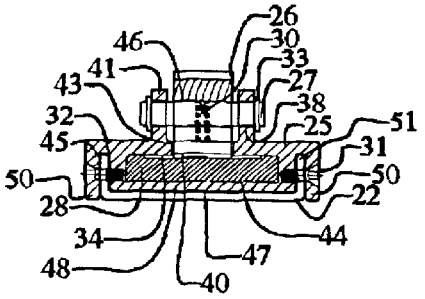
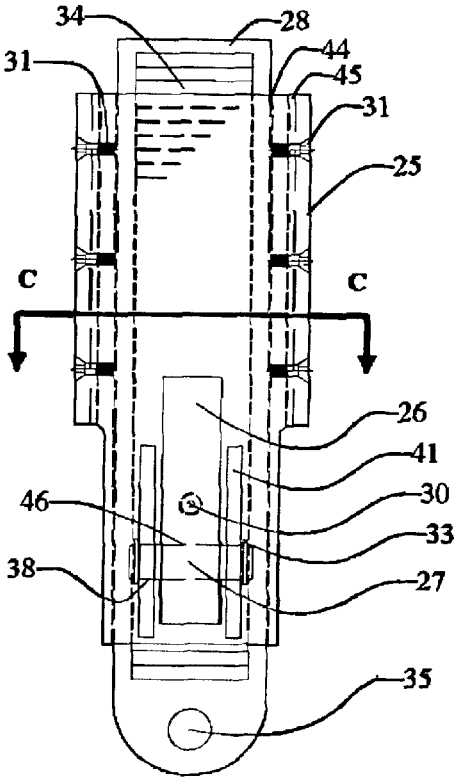
Fig.8

MACHINE FOR LEVELING A LADDER ON AN UNEVEN SURFACE

BACKGROUND OF THE INVENTION

This invention relates generally to the field of leveling attachments, and more particularly to a machine for leveling a ladder on a uneven surface.

Extension Ladders are useful tools on flat surfaces, but can be quite dangerous on uneven surfaces. This device will make it easier to level a ladder on such surfaces. Ladder leveling attachments in the past were time consuming to set up with pins, locks, bolts, and extra brackets. Plus a lot of extra weight was added to the ladder to drag around. Workmen would attempt to avoid all this extra work and use blocking instead. This would again increase the chance of injury. This machine or device is compact, no loose parts, easy to lock and unlock with just one lever on each side. This device would be lightweight and a permanent part of the ladder making it unnecessary for other attachments or blocks.

| Beck | Ladder Leveling Device | U.S. Pat. No. |
|---|---|---|
| | | 5,845,744 |

The Beck device has two housings that bolt to and extend out side each ladder leg. Both housings have a telescoping member with a lever inside attached to the ground end. This lever has a locking pin attached that extends through the telescopic member and engages one of the apertures in the housing, locking the telescoping member to the housing. Moving the lever to the unlock position, disengages the locking pin from the aperture, allowing the telescoping member to move to another position.

| Macyszyn | Ladder Level Adjusting Attachment | U.S. Pat. No. |
|---|---|---|
| | | 5,542,497 |

The Macyszyn device works in a similar fashion, but uses a cam self-locking mechanism to apply pressure against the telescoping inner channel member causing it to lock in a set position. A set of safety pins is provided for each inner channel member and is engaged in case of a cam self-locking mechanism failure. This device also mounts on the outside of each leg of the ladder.

| Cordell | Leveler attachment for ladders | U.S. Pat. No. |
|---|---|---|
| | | 4,802,471 |

The Cordell device bolts to the out side of each ladder leg with an outer rail. An inner rail telescopes within the outer rail, and is held in place by a gripping mechanism feeding threw an aperture with a sharp edge against the inner rail smooth surface. This gripping mechanism locks the inner rail to the outer rail. Moving the gripping mechanism to the unlock position allowing the inner rail to telescope another position.

There is extensive patent literature relating to ladder leveling devices. Most all of these devices attach to the outside of each ladder leg threw bolts, pins, or some sort of bracket. This tends to make these devices heavy, complicated, and awkward to use. This also increases the width of the ladder limiting the use in fight areas. All the weight on the ladder takes a zigzag path threw the leg, to the mounting bolt, then over to the leveling device, this makes for a weak support. Some of these devices attempt to lock the telescoping member in place by using a locking or gripping mechanism against a smooth surface. These tend to fail after the sharp edge on the locking device has worn. It is not believed that any of these devices have met with considerable commercial success.

SUMMARY OF THE INVENTION

The primary object of the invention is to make a much more compact, lighter, and user-friendlier Ladder Leveling device than any other on the market.

Another object of the invention is a device that supports the weight of the ladder in a straight line, directly under the load and does not increase the width of the ladder that it's installed on.

Another object of the invention is to provide a device that locks with no slip gear type teeth.

A further object of the invention is to provide a device that locks in place with more than one tooth for a strong grip.

Still yet another object of the invention is a device that has fewer parts than most Ladder Level attachments.

Another object of the invention is a device that adds very little weight to the Ladder it's attached to.

Another object of the invention is a locking Mechanism that locks tighter as the weight on the ladder increases.

A further object of the invention is a Release & Lock Lever that cannot be released with weight on the ladder for safety.

Other objects and advantages of the present invention will become apparent from the following descriptions, taken in connection with the accompanying drawings, wherein, by way of illustration and example, an embodiment of the present invention is disclosed.

A machine for leveling a ladder on a uneven surface, comprising: A support housing attached to one or both ladder legs, having an interior cavity for a telescoping leg, two outer cavities that allow said ladder to mesh with said support housing, two inner drilled lugs that support a release and lock lever, two outer drilled lugs that overlap said ladder legs, A release and lock lever attached to said support housing, that automatically locks into a telescoping leg by spring action when released, A release and lock lever, rotating on a rotation shaft ,with a positive gear tooth lock that engage into said telescoping leg, A telescoping leg with a large number of machined or molded gear teeth that telescopes out of the interior cavity of said support housing, A telescoping leg that telescopes freely into said support housing when the release and lock lever is released, A release and lock lever that rotates on a shaft and wedges into the telescoping leg according to the weight applied to the ladder, A shoe with a rubber pad with traction material for better gripping attached to said telescoping leg, A shoe that can rotate 180 degrees on said telescoping leg, A spring fixed between said release and lock lever and said support housing to hold the mechanism in the lock position until actuated, A rotation shaft fix between two support housing lugs held in place by lock rings, and.

The drawings constitute a part of this specification and include exemplary embodiments to the invention, which may be embodied in various forms. It is to be understood that in some instances various aspects of the invention may be shown exaggerated or enlarged to facilitate an understanding of the invention.

BRIEF DESCRIPTION OF THE DRAWINGS

The Figures on the drawings are briefly described as follows.

FIG. 6 is an enlarged cross sectional front view of the left leg;

FIG. 6A is an exploded view of the locking mechanism;

FIG. 7 is a cross sectional view of the device taken on line C—C of FIG. 8;

FIG. 8 is an enlarged cross sectional inside view of the device;

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
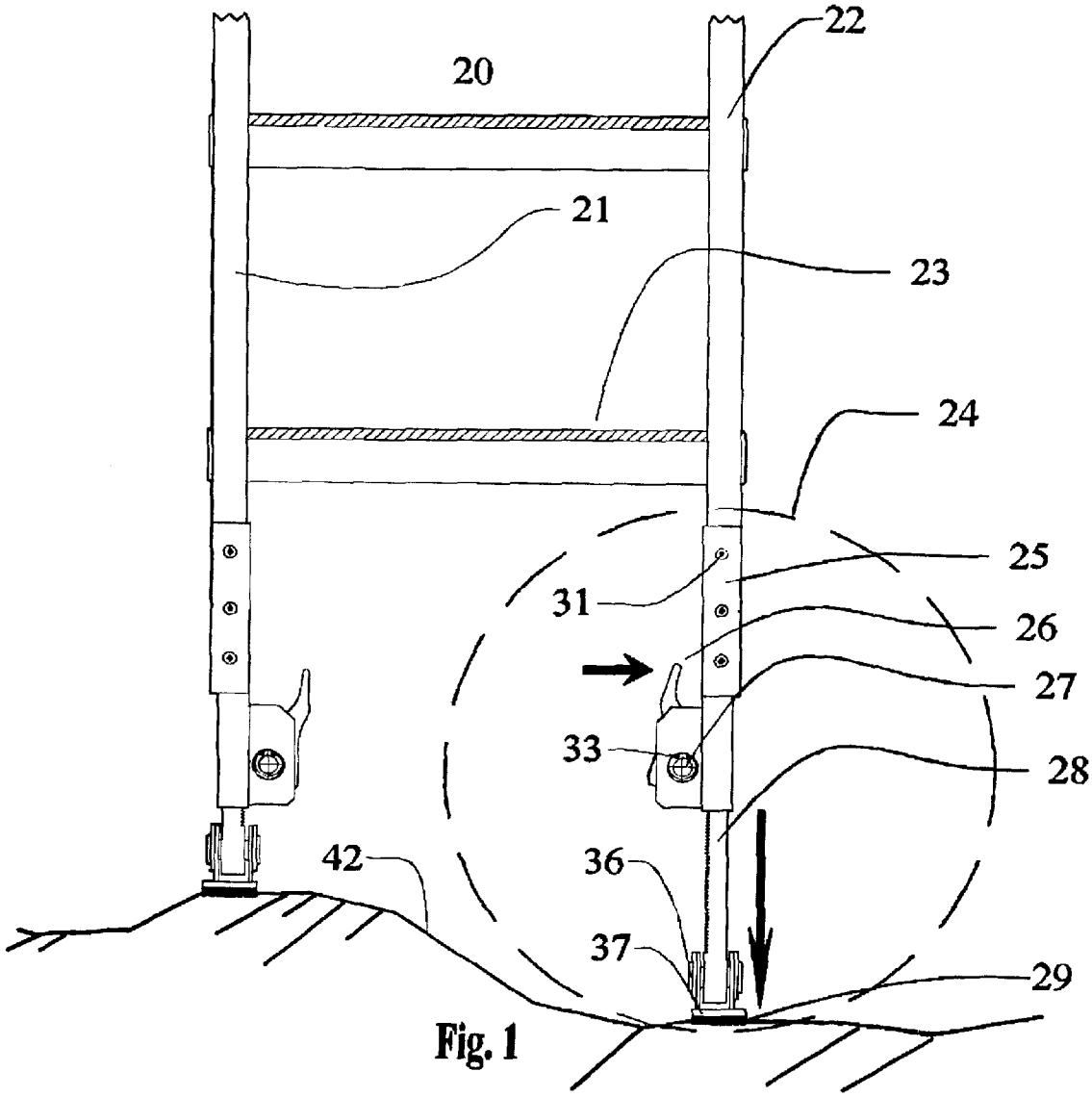
FIG. 1 is a front elevational view illustrating a ladder incorporating an embodiment of the device, as it would appear from the front on unleveled ground.
Figures 2, 3:
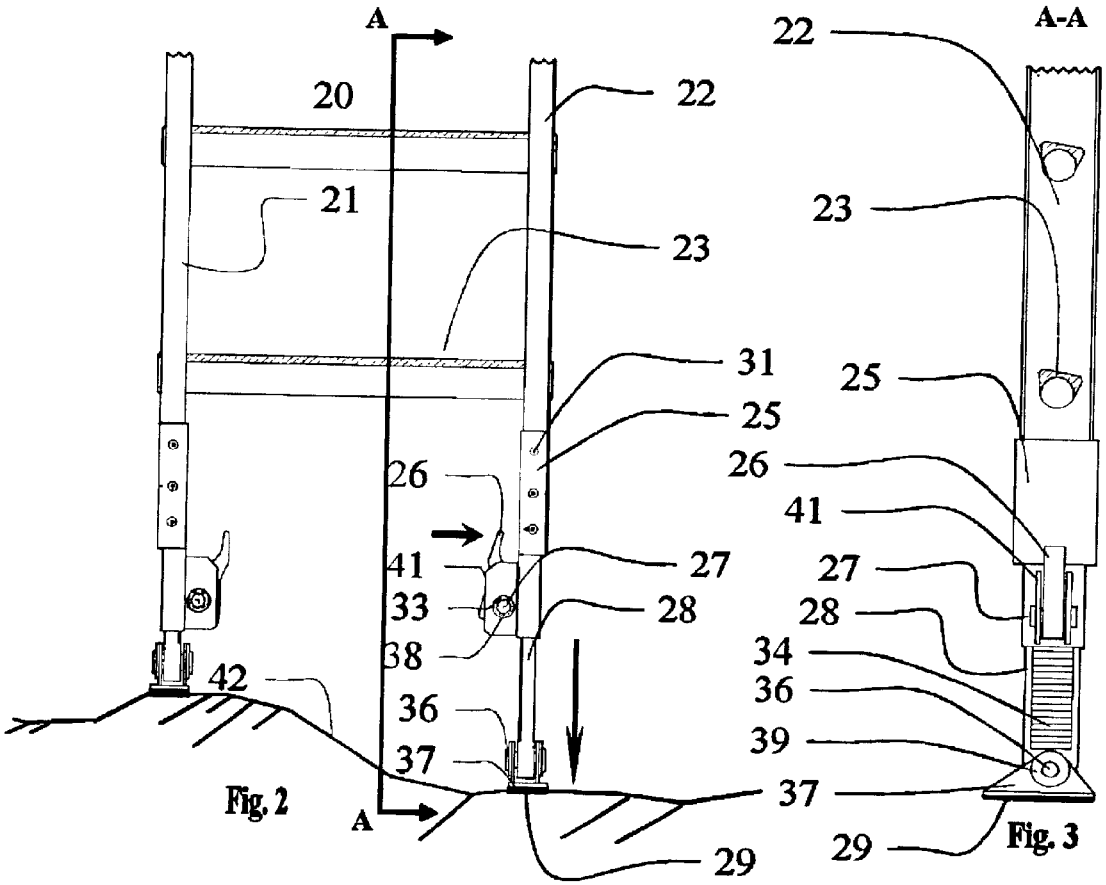
FIG. 2 is a front elevational view with one leg retracted and the other leg extended on unleveled ground
FIG. 3 is a right inside view taken on line A—A of FIG. 2.

Turning now to the drawings, in which similar reference characters denote similar elements throughout the several views, FIGS. 1 through 8 illustrate a ladder leveling machine adjusting attachment 24 for a standard extension ladder 20 of the type having a pair of generally parallel side rails, left rail 21 and right rail 22, a plurality of hollow rungs 23 interconnecting the side rails. The ladder level attachment 24 as shown in FIG. 1 comprising two independent, but identical height adjustable ladder levels, each having a pair of shoes 37 attached to each telescoping leg 28 and a rubber pad 29 molded into the shoe 37. One attached to the left rail 21 and one attached to the right rail 22. Each attachment 24 can be height adjusted independently to allow the ladder 20 to stand in a level position no matter how unequal the floor and ground conditions are. Such as the ground conditions 42 in FIG. 1 and 2 front elevational views.

Figures 4, 4A, 5:
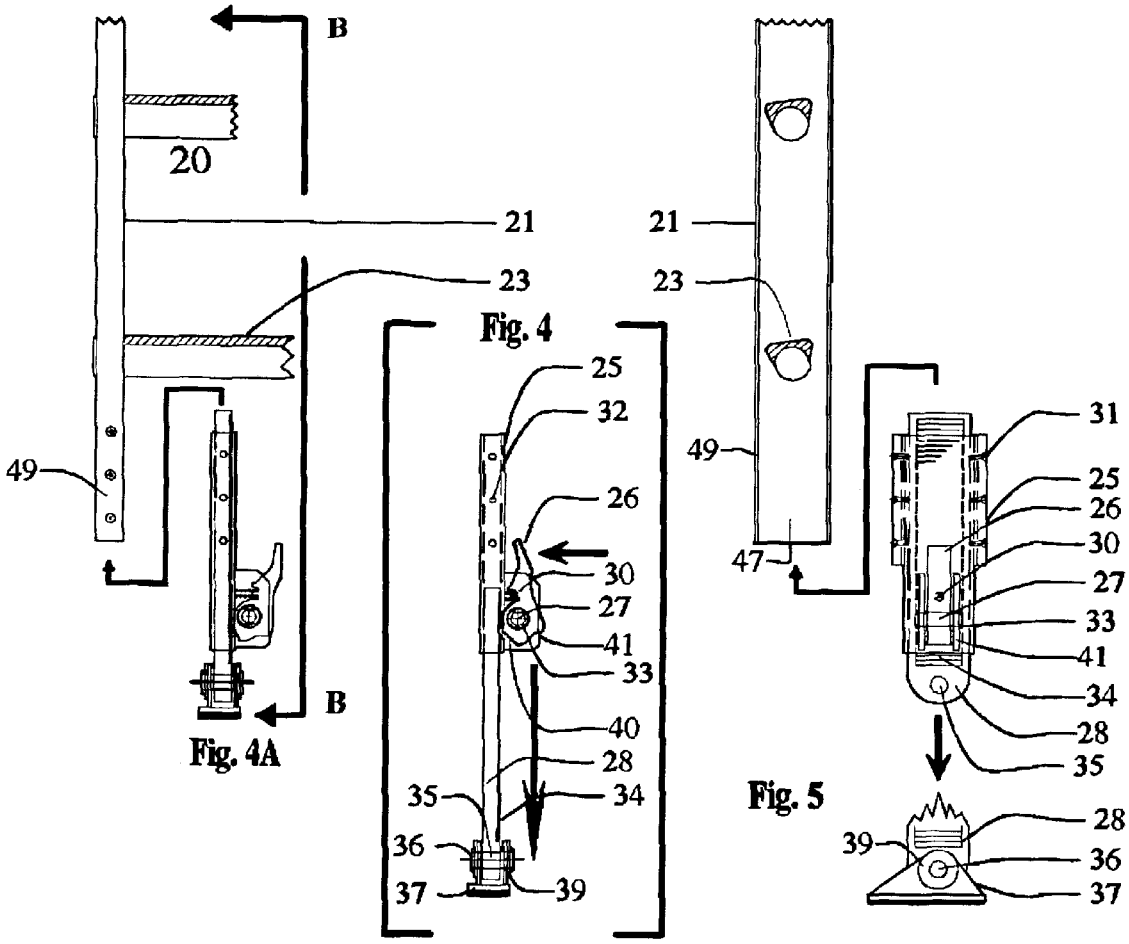
FIG. 4 is a front cross sectional view showing the same leg first retracted and then extended.
FIG. 4A shows the same leg in an extended position.
FIG. 5 is a cross sectional inside view of the left leg taken on line B—B of FIG. 4.

The ladder leveling attachment 24 is held together and supported by the support housing 25, best shown in FIG. 7 and 8 having an inner cavity 44 that supports and houses the telescoping leg 28. Inner cavity 44 is molded into protrusion 48, which is a part of support housing 25. Protrusion 48 meshes into the ladder 20 Inner cavity 47 as shown in FIG. 5 and 7. Two outer cavities 45 that mesh into lugs 51 of the ladder legs 21 and 22 at the base end 49 as shown in FIG. 4, and support housing 25 being clamped to legs 21 and 22 by a sufficient number of screws 31 on both sides, passing threw matching apertures in lugs 50, then threw ladder lugs 51 and then anchors back into support housing 25 at aperture 32. This insures superior support and aligns the ladder level 24 in the same plane as the ladder 20. Keeping ladder level 24 and ladder 20 in the same alignment plane increases its strength without increasing its width. Molded into and part of support housing 25 are two inner drilled lugs 41 with apertures 38 supporting the rotation shaft 27 which supports the release and lock lever 26.

One of the features of the invention is the release and lock lever 26 as best shown in FIGS. 6, 7 and 8, is a serf locking mechanism held in the locked position by spring 30. The release and lock lever 26 is supported by and rotates on shaft 27, rotation shaft 27 is aligned within and passes threw aperture 38 of lugs 41, and threw aperture 46 of release and lock lever 26 with lock rings 33 on both ends locking 27 in place. When the release and lock lever 26 is in the lock position, teeth 40 which are a molded part of the release and lock lever 26, fit threw the slotted aperture 43 best shown in FIG. 6 and mesh with teeth 34 which are a molded part of telescoping leg 28. The teeth 40 and 34 are cut in such a way that the telescoping leg 28 can ratchet out with a little force, but won't telescope inward. Increasing the inward force, according to the weight on ladder 20, pulls the teeth 40 in tighter to teeth 34 forcing the telescoping leg 28 up against the inner cavity wall of cavity 44 increasing the holding ability. It is a feature of the invention that unless the load on ladder 20 is not removed the release and lock lever 26 won't release making it unnecessary for any kind of safety pin or bolt. After the load is removed, pressing inward on lever 26 as shown by the arrow in FIGS. 2, 4, and 6 which would compress spring 30, disengage the release and lock lever teeth 40 from the telescoping leg teeth 34 allowing the telescoping leg to travel in or out freely.

Father in accordance with the invention ladder level 24 is telescoping leg 28 which is made up of a rigid lightweight material and housed in support housing 25 made of the same material. Telescoping leg 28 has aperture 35 molded or machined into the shoe end, and shaft 36 passes threw aperture 39 on one side of shoe 37, then threw aperture 35 and back threw the second aperture 39. The shaft 36 is swaged on both ends to lock it into its position and allowing it to rotate in aperture 35 a full 1800°. Shoe 37 has a rubber pad molded to its bottom for better gripping.

OPERATION OF THE INVENTION

The ladder leveling attachment 24 will be a permanent part of the ladder once installed and could also be installed on earlier models with screw 31 or rivets. Once the ladder 20 is positioned on the uneven surface 42, rotate the ladder to a level position, pressing inward on the release and lock lever 26 will free the teeth 40 from teeth 34 of the telescoping leg 28. This will allow the telescoping leg 28 to travel freely in and out to a position on the surface 42 that will hold the ladder 20 in a level position. Then releasing the release and lock lever 26, the spring 30 engages the release and lock lever 26 back in the locked position were teeth 40 are engaged with teeth 34 holding the ladder 20 in a level position.

While the invention has been described in connection with a preferred embodiment, it is not intended to limit the scope of the invention to the particular form set forth, but on the contrary; it is intended to cover such alternatives, Modifications, and equivalents as may be included within the spirit and scope of the invention as defined by the appended claims.

What is claimed is:

1. A ladder extension for a ladder having U-shaped side rails and rungs spaced there between, for leveling on an uneven surface, said extension comprising:

a support housing assembly, adapted to be secured on one of said side rails. the assembly having a hollow inner tubular chamber between space apart parallel outer cavities, the cavities adapted to matingly receive flange portions of said U-shaped side rails, said assembly having two identical parallel plates each having apertures therein which receive a shaft; and a lever attached to said assembly, said lever rotating on said shaft, said lever having a plurality of teeth and being biased into a lock position by an opposing spring; and an extendable leg supported within said inner tubular chamber of said assembly, said extendable leg being longitudinally secured to and longitudinally movable within said inner tubular chamber, said extendable leg having a plurality of teeth formed therein which contact said plurality of teeth of said lever when said lever is biased into the lock position, so as to actuate said lever away from said assembly; and a release position wherein said lever compresses said spring and rotates said plurality of teeth of said lever out of contact with the plurality of teeth of said extendable leg, thus allowing said extendable leg to move freely within said inner tubular chamber.

* * * * *